US005865343A

United States Patent [19]

Busch et al.

[11] Patent Number: 5,865,343

[45] Date of Patent: Feb. 2, 1999

[54] CHEMICAL DISPENSING SYSTEM

[75] Inventors: Bruce D. Busch, Shakopee; Michael T. Oldsberg, Chaska, both of Minn.

[73] Assignee: Fremont Industries, Inc., Shakopee, Minn.

[21] Appl. No.: 854,974

[22] Filed: May 13, 1997

[51] Int. Cl.[6] ..... B67B 7/00

[52] U.S. Cl. ..... 222/1; 222/148; 141/91; 141/330

[58] Field of Search ..... 222/1, 148, 325; 422/261; 141/91, 330

[56] References Cited

U.S. PATENT DOCUMENTS 5,299,606 4/1994 Schrupp ..... 222/148 X
5,494,644 2/1996 Thomas et al. .
5,505,915 4/1996 Copeland et al. .
5,584,327 12/1996 Thomas et al. .
5,607,651 3/1997 Thomas et al. .
5,638,988 6/1997 Rogers et al. ..... 141/330 X

*Primary Examiner*—Gregory L. Huson
*Attorney, Agent, or Firm*—Haugen and Nikolai, P.A.

[57] ABSTRACT

A dispensing system for particulate solid chemical materials is disclosed that includes a charging hopper for receiving a sealed chemical container of solid particulate material to be dispersed, a delivery pipe attached to the charging hopper for conducting materials from the hopper by gravity, a seal piercing means disposed in the charging hopper for opening the sealed container and allowing the solid particulate material to flow from the chemical container into the delivery pipe and a liquid rinsing device including a discharge pipe member for delivering rinse liquid to rinse the hopper and chemical container.

10 Claims, 5 Drawing Sheets

CHEMICAL DISPENSING SYSTEM

BACKGROUND OF THE INVENTION

I. Field of the Invention

The present invention is directed generally to a system for adding dry chemical concentrate materials in particulate form to a liquid dilution system and, more particularly, the invention deals with an improved noncontact, batch addition system for adding free-flowing particulate solid chemicals in a liquid dispersion that avoids worker contact, precludes spillage and eliminates container residue.

II. Related Art

A number of different techniques have been developed and used for solubilizing dry chemical materials into solutions for water treatment, cleaning and other uses. Such systems have been designed to include an infusion device that sprays a stream of water into a solid mass which may be a block or amount of powder of a concentrated composition for a limited period of time to produce a liquid chemical concentrate which may then be diluted with the appropriate amount of water or other solvent to form the desired solution for the particular use involved. Multiple product dispensing systems including dispensing systems for forming use solutions from solid chemical compositions are exemplified by U.S. Pat. Nos. 5,607,651; 5,494,644; and a single solid chemical dispensing system exemplified by U.S. Pat. No. 5,505,915.

Whereas each of these prior devices and systems address certain problems associated with the creation of solutions of a given concentration utilizing solid chemical feed materials, while these systems address the handling of dry chemical additives in solid block form, they have not addressed problems of batch addition of free flowing dry and particulate materials. This is particularly true of avoiding contact between those operating the system and the chemicals involved including contact with associated dust or vapors from the particulate material. There further remains a need for such a system which is entirely compatible with free-flowing crystalline or other free-flowing solid particulate materials supplied from bulk containers in totally dry form.

Accordingly, it is a primary object of the present invention to provide a free-flowing solid delivery system that dispenses solid chemical materials into a mix tank without exposure of the chemicals to those operating the system or to the environment.

Another object of the invention is to provide a solid chemical material delivery system which eliminates waste through complete product transfer while reducing container residues and the risk of hazardous spills to the environment.

A further object of the invention is to provide a delivery system for free-flowing solid materials which is relatively simple in construction and easily operated.

Other objects and advantages of the invention will become apparent to those skilled in the art upon familiarization with the specification, drawings and claims contained herein.

SUMMARY OF THE INVENTION

By means of the present invention, there is provided an improved batch addition system for charging free-flowing dry chemical products into a mixing tank which avoids contact with the operator. The system optimizes handling safety and maximizes environmental friendliness by accomplishing transfer from bulk containers without the danger of spillage or personal chemical contact including inhalation of dust or vapor from opened containers.

The dry chemical delivery or dispensing system of the invention includes a charging receptacle or hopper designed to receive a supply product container to be inverted in the hopper and emptied of a generally free-flowing material in batchwise fashion. The receptacle and supply container are preferably keyed to one another by similar or congruent asymmetries form. The charging hopper is further provided with a piercing device that aligns with a tight but suitably thin and puncturable seal on the product container which remains when the cap is removed. The seal may be of a foil, polymeric or other chemically benign material. The piercing device in one embodiment is in the form of a multi-surfaced beveled cutting system formed from a plurality of radially divergent, chemically compatible shearing blades which converge to a common upward directed point which breaches the seal as the container is fully inserted into the hopper. An opening is provided in the charging receptacle beneath the piercing device through which the contents of a product container are transferred to a chemical mixing tank to which the charging receptacle is designed to be fixed and usually permanently mounted, preferably by means of a pipe connecting the two and extending a distance into the mixing tank. A mounting flange fixed to the pipe may be, in turn, fixed to the mixing tank.

A solvent infusion or rinse system is provided which delivers water or other liquid solvent material at the vicinity of discharge of the product container, preferably in a manner that produces a flushing or washing of both the product container and the charging hopper. In one embodiment, an infusion or discharge pipe, is mounted in central recesses in the piercing device to direct water upward into the product container to flush the container and clean the charging hopper. The solvent or water infusion system is suitably valved to a source and may be provided with a meter and/or pressure reduction or regulating device if desired. The washing system may be permanently connected or may employ "quick disconnects" or other easily separated reusable connecting devices. The mixing tank is further provided with mechanical agitation to promote dissolution of the delivered material to form the desired solution.

The materials of construction of the delivery system, the mixing tank and agitation system may vary, but should be compatible with the chemicals intended to be contacted. Of course, the plurality of diverse materials can be sequentially added but the effects of mixtures must also be considered along with the relevance of heat generation on dissolution.

BRIEF DESCRIPTION OF THE DRAWINGS

In the drawings, wherein like reference characters denote like parts throughout the same.

DETAILED DESCRIPTION

The present invention enables the clean and safe transfer of particulate solid chemical materials from supply containers to a solution of desired first dilution by the provision of a batch dispensing arrangement which opens and empties containers with considerable ease. The system is particularly well suited to free-flowing solids and, more particularly, crystalline solids such as might be used as a source of water treatment chemicals. However, the embodiments described herein are meant to portray examples of the system and method of the invention and not to limit the scope of the invention in any manner.

Figure 1:
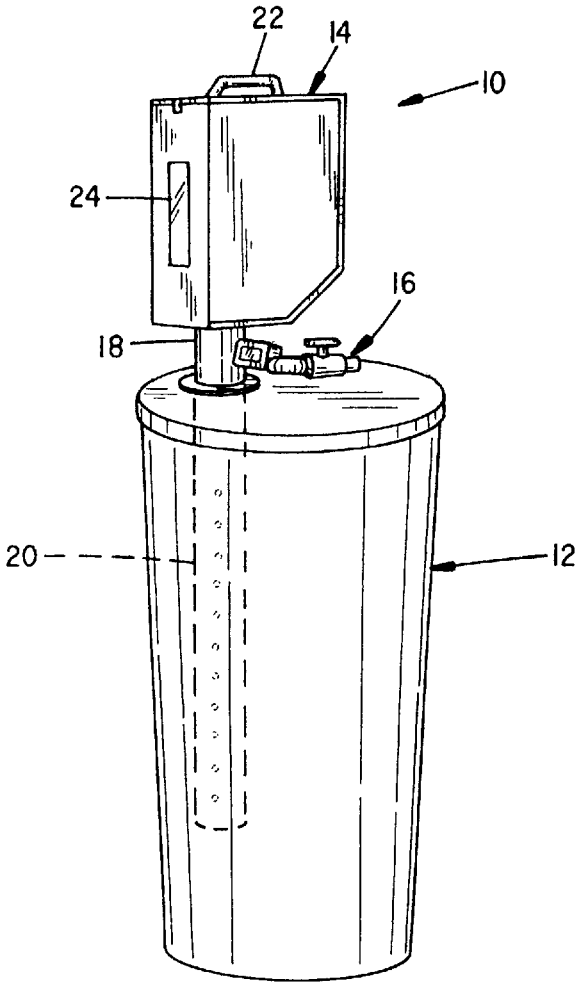
FIG. 1 is a perspective view of the chemical dispensing system of the invention as mounted on a mixing tank.
Figure 2:
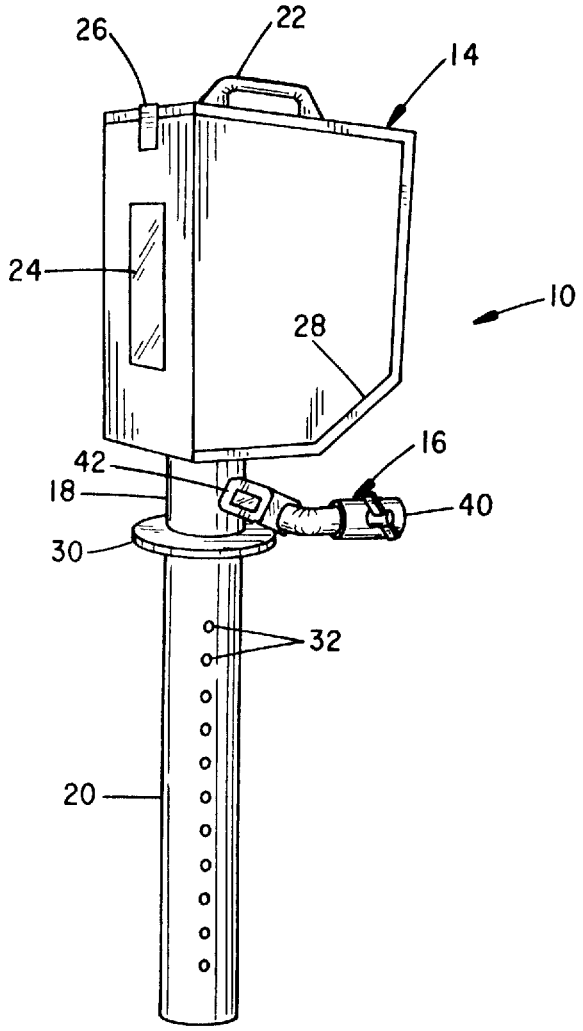
FIG. 2 is a perspective view of the chemical dispensing system of the invention as depicted in FIG. 1 without the connected mixing tank.

FIGS. 1 and 2 of the drawings are perspective views of an assembled delivery or addition system in accordance with the invention which is shown, generally at 10, mounted on a chemical mixing vessel such as a tank or drum 12 (FIG. 1) and includes a charging receptacle or hopper 14, a solvent infusion or rinse water system 16 and feeder delivery pipe 18 which extends into the solution mixing vessel 12 a considerable distance at 20. The charging hopper 14 further includes a hinged lid 22 and a sight glass at 24 which can better be seen in FIGS. 2 and 3. Cover 22 is provided with a latch as at 26 and the hopper 14 is designed with an asymmetric lower beveled area at 28. The delivery pipe 18 includes a mounting flange 30 which is used to fix system 10 onto the mixing vessel by a connecting means such as self-tapping screws or bolts and to further space the hopper 14 from the vessel as indicated. Portion 20 of the pipe 18 extends into the mixing vessel and may be adjusted as to length depending on the vessel used and is provided with a plurality of infusion holes, which are depicted at 32. As will be discussed in greater detail below, the nominally water, infusion or rinse system 16 includes a shut-off valve 40 and optionally an in-line metering device 42. While other solvent combinations are possible, the most general application involves the combination of chemical additives with water for any of many contemplated processes and so water is the solvent described herein.

Figure 3:
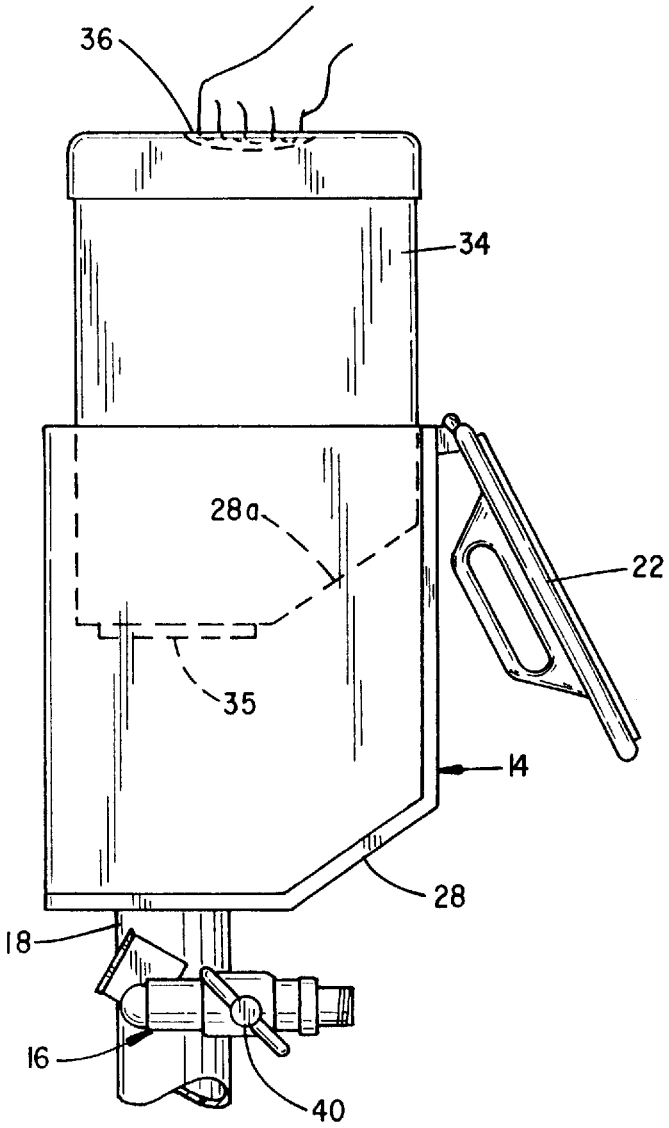
FIG. 3 is a side view of the receiving hopper depicting the placement of a product container to be emptied into the hopper.

FIG. 3 depicts the hopper 14 with cover 22 open and a supply container 34 with bottom handle for inserting the container 34 (partly in phantom) into the hopper 14 in an inverted position shown at 36. The container 34 is shown partially inserted and note that it is also provided with a beveled or mitered area 28(*a*) that nests against the beveled edge 28 of the hopper when the container 34 is inverted correctly into the hopper 14.

Figure 4:
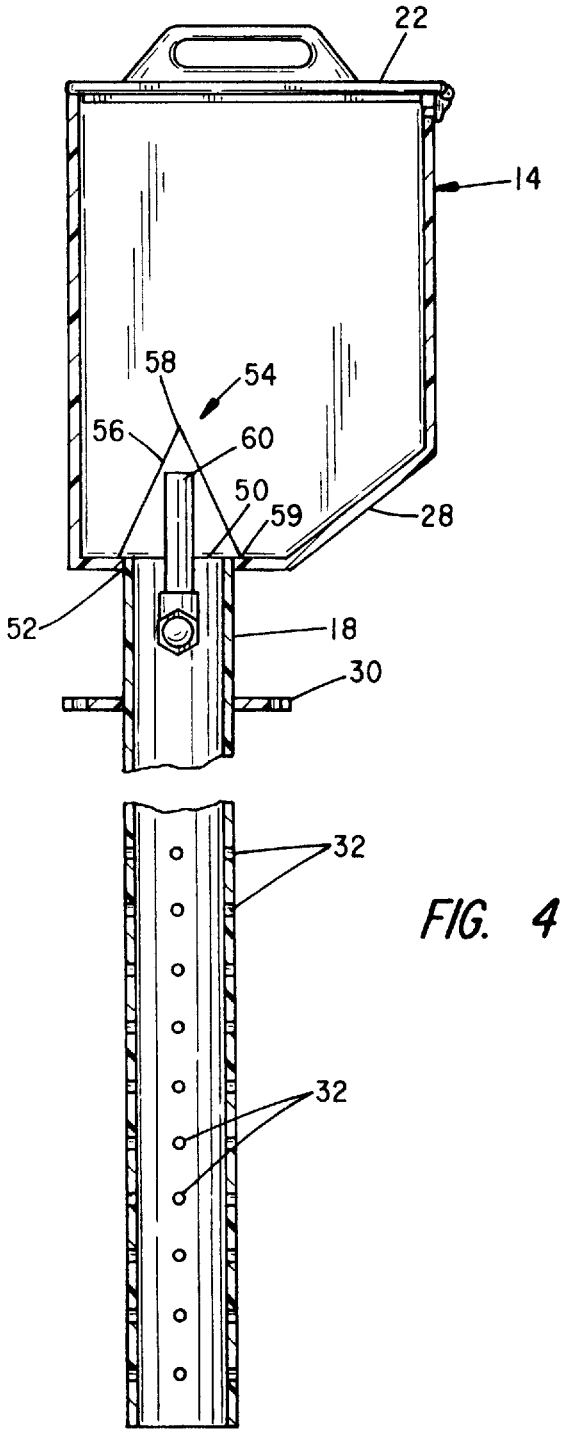
FIG. 4 is a side view of the chemical dispensing system showing additional details.
Figure 5:
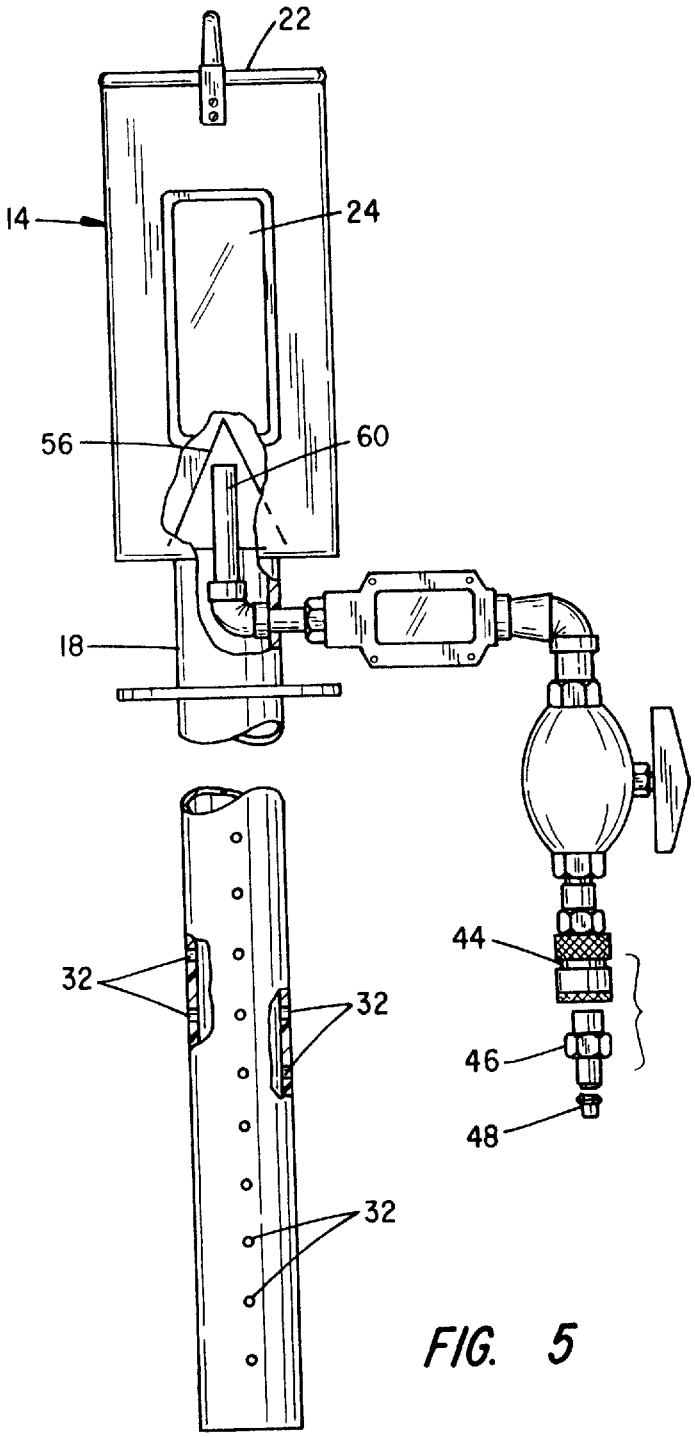
FIG. 5 is an end view of the chemical dispensing system of FIG. 4 including details of a connected wash water rinse system.

Further details, particularly with regard to the water infusion system and chemical releasing mechanism, are found in FIGS. 4 and 5. An opening 50 in the bottom of the receptacle or hopper 14 receives one end of the hollow feeder delivery pipe 18 which is peripherally secured as at 52.

A piercing or cutting device in the form of a shearing blade system 54 having a plurality of radially divergent shearing blades which converge to an upper penetrating point at 58 and diverge beyond the opening 50 to be supported on shoulders 59 at the pipe/hopper interface. The piercing device 54 may include a pair of single shearing blades at right angles to a double blade, all of which are provided with central recesses to accommodate a solvent rinse or water infusion poke pipe 60 which serves as the outlet for the rinse water system 16 and blasts straight up into the hopper 14 and opened container to be drained 34, as will be described.

In addition to the valve 40 and metering device 42, the piping assembly for rinse water may include quick disconnect parts 44, 46 and 48 (FIG. 5) which connect to a flexible hose or the system may be permanently plumbed to a suitable source (not shown) in a well-known manner.

The rinse water system is typically a 1-inch or a ¾-inch ID system and the meter is typically a turbine driven meter with digital display and the desired totalizers which may be used to compute batch dilution if desired. Of course, in some embodiments, the meter may be omitted and other means of determining dilution such as sight or level gauge is used in association with the tank. Preferred materials of construction are relatively inert chemically compatible durable plastic materials which may be polyolifins, modified polyolifins or the like.

The feed pipe 18, 20 is typically of 3-inch schedule 80, high density polyethylene (HDPE) or polypropylene (N.P.P). The pipe section, the lower section of which, in one embodiment, is provided with rows of spaced ⅜ inch holes at 90° rotational spacing. The charging hopper assembly, the blades of the piercing device which are attached to the poke pipe are typically of suitable polymer material such as white polypropylene (W.P.P).

The mixing tank may be a 35 or 55 gallon tank as illustrated in FIG. 1 or a dike tank system and is typically fabricated from high density polyethylene (HDPE). The mixing tank is provided with a mechanical agitator (not shown) such as a 1/20 HP or other fractional horsepower agitators with an appropriate shaft length and impeller respective of the tank used. The agitator is mounted on the tank in a manner that insures that the shaft and mixing blades clear other parts of the system. The use of such agitators is well known and needs no further explanation.

The operation of the system is advantageously quite simple and this simplicity forms part of the value of the invention. At the beginning of an addition cycle, it is assumed that sufficient water has been admitted to the mixing tank to at least cover the lower open end of the feed pipe 20 which, in turn, should sufficiently clear the bottom of the tank so that it does not interfere with proper dispersion of the dry chemical to be added. Thus, assuming the liquid level to be adequate or having been adjusted to an adequate level, one may initialize the addition cycle.

The mechanical agitation system is turned on and the cover 22 of the charging hopper 26 is opened. Any cap is removed from the free-flowing product container, care being taken not to damage the membrane seal 35. The product container is then inserted into the charging hopper 14 in an inverted posture utilizing the bottom handle 36, the charging hopper 14 being of sufficient size to totally contain the product container 34. The cover 22 is then again closed and latched, the piercing device 54 having opened the product container by shearing the seal 35.

The water valve 40 can now be fully opened to initiate product transfer and, if a water meter be used, the water meter may be activated either by starting water flow through the meter or by pressing a display button on the meter. A meter may be used to totalize the water utilized for the transfer and/or to maintain a running total of the water transferred to the mixing tank 12. Water addition is continued until the product has been completely transferred, the product container fully rinsed of product residue and the desired water volume has been added to the chemical mix tank. To provide maximum efficiency of product transfer and container rinsing, it may be advantageous to intermittently turn of f the water flow to the dispersion system and allow the product container to drain into the chemical mix tank before resuming water flow to the system. Progress can be periodically observed through the sight glass 24 if desired.

After transfer has been completed, the cover 22 may be again unlatched and opened and the empty, rinsed container removed and preferably placed in recycle. If any chemical residue is observed to remain in the charging hopper, the lid can be again closed and latched and the water valve opened to a fraction of capacity to provide minimal water flow to accomplish a final rinse.

After complete dissolution of the product has been accomplished, the mechanical agitation can be discontinued and the prepared solution utilized as desired. Of course, a plurality of materials may be sequentially added as necessary to prepare the desired final solution in the tank.

Because heats of solution vary and may be quite exothermic, cold water should be used for the transfer and dissolution process.

This invention has been described herein in considerable detail in order to comply with the patent statutes and to provide those skilled in the art with the information needed to apply the novel principles and to construct and use embodiments of the example as required.

However, it is to be understood that the invention can be carried out by specifically different devices and that various modifications can be accomplished without departing from the scope of the invention itself.

What is claimed is:

1. A dispensing system for particulate solid chemical materials comprising:

(a) a charging hopper for receiving a sealed chemical container of solid particulate material to be dispersed;

(b) a delivery pipe attached to said charging hopper for conducting materials from said hopper by gravity;

(c) seal piercing means disposed in said charging hopper for opening said sealed container and allowing said solid particulate material to flow from said chemical container into said delivery pipe; and (d) liquid rinse device including a discharge pipe member for delivering rinse liquid to rinse said hopper and said chemical container.

2. The dispensing system of claim 1 wherein said seal piercing means comprises a plurality of vertically disposed shearing blades.

3. The dispensing system of claim 1 further comprising a metering device for measuring the flow from said liquid rinse device.

4. The dispensing system of claim 1 wherein said charging hopper for receiving said sealed chemical container is provided with an asymmetrical shape to receive a correspondingly shaped chemical container so as to assure proper alignment in said hopper.

5. The dispensing system of claim 2 wherein said charging hopper for receiving said sealed chemical container is provided with an asymmetrical shape to receive a correspondingly shaped chemical container so as to assure proper alignment in said hopper.

6. The dispensing system of claim 1 wherein said chemical container is provided with a relatively thin sealing membrane over a discharge opening therein to be reached by said seal piercing means.

7. The dispensing system of claim 1 further comprising mixing tank means connected to receive the discharge from said delivery pipe.

8. The dispensing system of claim 7 including means for mounting said dispensing system on said mixing tank.

9. The dispensing system of claim 1 wherein said charging hopper further comprises cover means for sealing said chemical container in said charging hopper during the emptying thereof.

10. A method of dispensing free-flowing particulate solid chemical materials into a mixing device comprising the steps of:

(a) providing an invertible sealed chemical container;

(b) inverting said sealed chemical container into a sealable charging hopper for receiving said sealed chemical container and causing said seal to be broken only when said chemical container is properly positioned in said charging hopper; and (c) Sealing said chemical container in said charging hopper and providing a washing liquid to wash said charging hopper and said chemical container and deliver said solid particulate material from said charging hopper.

* * * * *